US009859083B1

(12) United States Patent
Thomas

(10) Patent No.: US 9,859,083 B1
(45) Date of Patent: Jan. 2, 2018

(54) LINKAGE-BASED OFF-STOP APPARATUS AND METHODS FOR CIRCUIT BREAKERS

(71) Applicant: Siemens Aktiengesellschaft, München (DE)

(72) Inventor: Stephen Scott Thomas, Atlanta, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/225,935

(22) Filed: Aug. 2, 2016

(51) Int. Cl.
*H01H 9/28* (2006.01)
*H01H 71/10* (2006.01)

(52) U.S. Cl.
CPC ... *H01H 71/1054* (2013.01); *H01H 2300/024* (2013.01)

(58) Field of Classification Search
CPC ..... H01H 3/02; H01H 71/00; H01H 71/1054; H01H 71/10; H01H 71/121; H01H 71/50; H01H 71/501; H01H 71/52; H01H 71/522; H01H 71/526; H01H 2300/24; H01H 2003/32; H01H 2009/20; H01H 3/00
USPC ..... 200/43.01, 43.11, 43.16, 43.19, 43.22, 200/50.01, 410, 416, 425, 426, 428, 440, 200/553, 557, 566, 249, 250, 318, 318.1, 200/318.2, 330, 337, 339
See application file for complete search history.

(56) References Cited

U.S. PATENT DOCUMENTS

| | | | | |
|---|---|---|---|---|
| 5,142,112 | A * | 8/1992 | Parks | H01H 71/501 200/401 |
| 5,628,394 | A | 5/1997 | Benke et al. | |
| 6,222,143 | B1 | 4/2001 | Lawson et al. | |
| 7,843,290 | B2 | 11/2010 | Song et al. | |
| 7,864,003 | B2 | 1/2011 | Yang | |
| 8,901,446 | B2 | 12/2014 | Fong | |
| 9,281,150 | B2 | 3/2016 | Warne | |
| 2004/0245081 | A1 * | 12/2004 | Vierling | H01H 71/526 200/400 |
| 2009/0039988 | A1 | 2/2009 | Song et al. | |
| 2009/0189719 | A1 | 7/2009 | Yang | |

(Continued)

OTHER PUBLICATIONS

Chen, Xinhua and Thomas, Stephen Scott; Siemens U.S. Appl. No. 14/867,094, filed Sep. 28, 2015 entitled Apparatus and Methods for a Circuit Breaker Positive-Off Stop Eature; (32 pages).

*Primary Examiner* — Anthony R. Jimenez

(57) ABSTRACT

An off-stop mechanism for a circuit breaker. Off-stop mechanism includes a handle moveable to an OFF configuration, the handle including a blocking engagement portion, a blocking member pivotally coupled at a pivot location, a linkage coupled between a cross bar housing and a linkage attachment location of the blocking member, the linkage being configured to: position the blocking member in an unblocked orientation when the main contacts are not fused together, and in a blocked orientation when the main contacts are fused together, wherein blocking member in the blocked orientation engages the blocking engagement portion as the operating handle is moved to the OFF configuration wherein the engagement places the blocking member in compression between the pivot location and the blocking contact portion. Circuit breakers including the off-stop mechanism and methods of operating a circuit breaker are also provided, as are other aspects.

19 Claims, 8 Drawing Sheets

(56) References Cited

U.S. PATENT DOCUMENTS

| | | | |
|---|---|---|---|
| 2012/0085627 | A1 | 4/2012 | Yang |
| 2012/0199449 | A1 | 8/2012 | Fong |
| 2013/0088310 | A1 | 4/2013 | Yang |
| 2014/0251769 | A1 | 9/2014 | Chen |
| 2015/0035628 | A1 | 2/2015 | Warne |

* cited by examiner

LINKAGE-BASED OFF-STOP APPARATUS AND METHODS FOR CIRCUIT BREAKERS

FIELD

Embodiments of the invention relate to circuit breakers, and more particularly to circuit breakers having an off-stop feature that prevents the operating handle from moving into an OFF position under certain conditions.

BACKGROUND

Circuit breakers may be used to protect an electrical circuit coupled to an electrical power supply. Circuit breakers may automatically interrupt power to the electrical circuit when, e.g., an overcurrent situation (i.e., excessive current) is detected. An overcurrent may result from, e.g., a short circuit, an overload, a ground fault, or the like. Automatic interruption of power is desired because it may prevent electrical shock hazards and/or damage to electrical equipment and surrounding infrastructure. Circuit breakers may also be manually operated to connect and disconnect power to and from an electrical circuit by throwing an operating handle pivotally mounted relative to the molded case of the circuit breaker. The operating handle typically has three configurations: ON, OFF, and TRIPPED. The ON position indicates that the main contacts of the circuit breaker are closed (i.e., in contact with each other), which connects power to the protected electrical circuit. The OFF configuration indicates that the main contacts have been opened manually via the operating handle to disconnect power from the electrical circuit. The TRIPPED configuration typically indicates that the main contacts have been opened automatically via a tripping mechanism in response to detection of an overcurrent, which disconnects power from the electrical circuit.

Under some abnormal operating conditions, the main contacts may become welded, fused, or otherwise stuck together. For example, a high in-rush current and/or a partial failure and/or a delay of the tripping mechanism may cause the main contacts to overheat to a point where they may melt and fuse together. This fused condition may go undetected. Consequently, a subsequent movement of the operating handle into the OFF configuration may not result in opening of the fused main contacts. This may erroneously indicate that power is disconnected from the protected electrical circuit when, in fact, power remains connected.

Accordingly, improved apparatus and methods that accommodate for such situations where the main contacts of the circuit breaker have become fused together are desired.

SUMMARY

According to one embodiment, an off-stop mechanism for a circuit breaker is provided. The off-stop mechanism includes an operating handle moveable to an OFF configuration, provided main contacts of the circuit breaker are not fused together, the operating handle including a blocking engagement portion, a cross bar housing, a blocking member pivotally coupled at a pivot location and rotatable between an unblocked orientation and a blocked orientation, the blocking member including a linkage attachment location and a blocking contact portion, a linkage coupled between the cross bar housing and a first location on the blocking member, the linkage being configured to: position the blocking member in an unblocked orientation provided that the main contacts are not fused together, and configure the blocking member to a blocked orientation in response to the main contacts being fused together, wherein the blocking member in the blocked orientation is configured to engage the blocking engagement portion as the operating handle is moved to the OFF configuration and the engagement places the blocking member under a compressive force between the pivot location and the blocking contact portion.

According to another embodiment, a circuit breaker is provided. The circuit breaker includes a first side frame and a second side frame, an operating handle pivotally mounted to the first side frame and second side frame, the operating handle moveable to an OFF configuration provided main contacts of the circuit breaker are not fused together, the operating handle including a first leg and a second leg and a blocking engagement portion on one of the first and second legs, a cross bar housing, a blocking member pivotally coupled to one of the first side frame and the second side frame at a pivot location and rotatable between an unblocked orientation and a blocked orientation, the blocking member including a linkage attachment location and a blocking contact portion, a linkage coupled between the cross bar housing at a first end and the linkage attachment location on the blocking member at a second end, the linkage being configured to: position the blocking member in the unblocked orientation provided that the main contacts are not fused together, and configure the blocking member to the blocked orientation if the main contacts are fused together, wherein the blocking member in the blocked orientation is configured to engage the blocking engagement portion as the operating handle is moved to the OFF configuration and the engagement places the blocking member under a compressive force between the pivot location and the blocking contact portion.

According to a further embodiment, a method of operating a circuit breaker including an off-stop mechanism is provided. The method includes providing an operating handle moveable towards an OFF configuration to separate main contacts, the operating handle including a blocking engagement portion, providing a blocking member including a blocking contact portion, the blocking member pivotally mounted at a pivot location, a cross bar housing, and a linkage pivotally coupled between the cross bar housing and the blocking member, the blocking member moveable between a blocked orientation and an unblocked orientation by the linkage dependent upon whether main contacts are fused, moving the operating handle towards the OFF configuration, and maintaining a positioning the blocking member in the blocked orientation with the linkage as the cross bar housing fails to rotate due to the main contacts being fused; and blocking further motion to the OFF configuration by contact between the blocking engagement portion of the operating handle and the blocking contact portion of the blocking member, wherein the blocking compresses the blocking member between the blocking contact portion and the pivot location.

Still other aspects, features, and advantages of the invention may be readily apparent from the following detailed description wherein a number of example embodiments are described and illustrated, including the best mode contemplated for carrying out the invention. The invention may also include other and different embodiments, and its several details may be modified in various respects, all without departing from the scope of the invention. The invention covers all modifications, equivalents, and alternatives of the aspects disclosed herein.

BRIEF DESCRIPTION OF DRAWINGS

The drawings, described below, are for illustrative purposes only, and are not restrictive. The drawings are not necessarily drawn to scale and are not intended to limit the scope of this disclosure in any way.

DETAILED DESCRIPTION

Reference will now be made in detail to the example embodiments, which are illustrated in the accompanying drawings. Wherever possible, the same reference numbers will be used throughout the drawings to refer to the same or like parts.

Figure 1A:
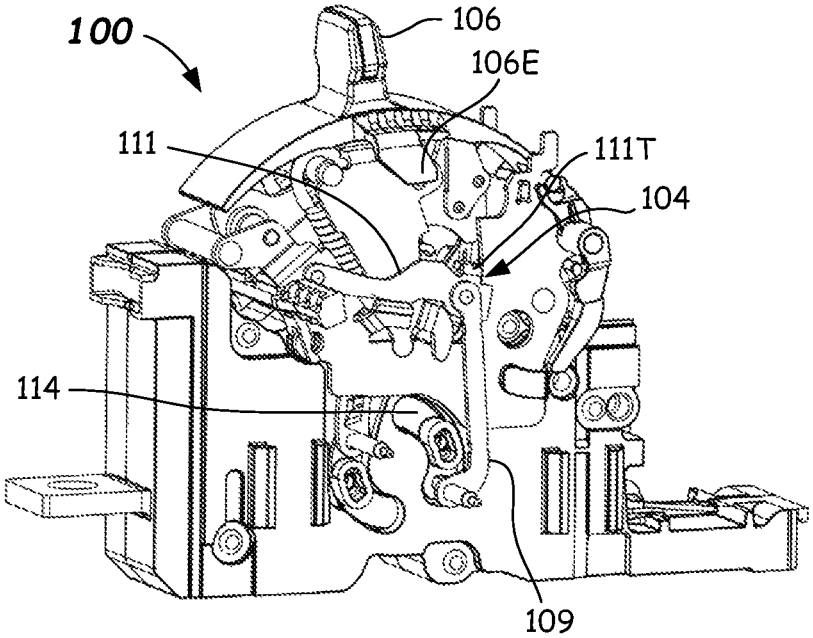
FIG. 1A Prior Art
FIGS. 1A and 1B illustrate side isometric views of a circuit breaker including an off-stop mechanism according to the prior art.
Figure 1B:
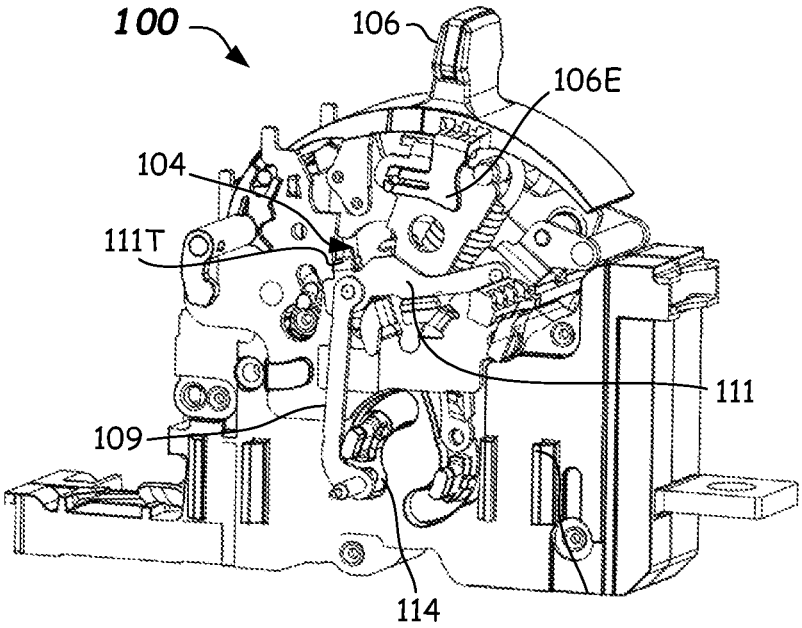
FIG. 1B Prior Art

FIGS. 1A and 1B illustrate isometric side views of a prior art circuit breaker 100 including an off-stop assembly 104. The assembly 104 includes a linkage 109 coupled to a cross bar housing 114 and to a blocking member 111, shown in an unblocked configuration. In this prior art assembly 104, if the main contacts (now shown) have become welded together, the linkage 109 will not be pulled downward as shown, but will maintain its position when the contacts are closed because of the failure of the cross bar housing 114 to rotate. Thus, the blocking member 111 remains rotated upwardly and a blocking contact portion 111T of the blocking member contacts the engagement portion 106E as the user attempts to throw the operating handle to the OFF configuration. When contact occurs, the linkages 109 on both side of the circuit breaker 100 are placed in compression. Because of the force, two linkages may be used to prevent buckling thereof. Further, the contact force vector may cause undesirable bending moments and twisting of the blocking member 111.

In view of one or more of the problems of the linkages 109 being placed in compression and bending forces on the blocking member 111, when the operating handle 106 is being moved to the OFF configuration, improved off-stop mechanisms and circuit breakers including the improved off-stop mechanism are provided.

In one aspect, a circuit breaker includes an improved off-stop mechanism. The off-stop mechanism blocks the operating handle from closing to the OFF configuration when the electrical contacts become fused together for any reason. According to embodiments of the invention, loads in the linkage are minimized thus reducing or eliminating bending and bucking concerns. Further, the blocking member may be provided in compression and may be made substantially shorter than the linkage. Further, the number of linkages may be reduced, so that one blocking assembly (a single blocking assembly) may be provided only on one side of the circuit breaker.

Under normal conditions, an assembly of operating components (e.g., operating handle and connected components) may cause the main contacts (main electrical contacts) to manually open and close. Similarly, the assembly of operating components may also cause the main contacts to automatically open in response to an overcurrent event detected by a tripping mechanism. However, should the main contacts of the circuit breaker become fused together (e.g. welded together), such as a result of an above-mentioned abnormal occurrence, the off-stop mechanism incorporated in the assembly of operating components is configured to prevent the operating handle from being moved into the OFF configuration. The off-stop mechanism thus may provide a user a visual and/or tactile indication via the blocked motion of the operating handle into the OFF configuration. This may indicate that power has not been disconnected and/or that something is wrong. Thus, embodiments of the invention may avoid the situation where an operating handle set in the OFF configuration, which may erroneously indicate that power has been disconnected when, in fact, it has not.

In more detail, improved off-stop mechanisms, circuit breakers including the off-stop mechanism, and methods of operating a circuit breaker including the off-stop mechanism are provided, as will be explained in greater detail below with reference to FIGS. 2A-7 herein.

Figure 2A:
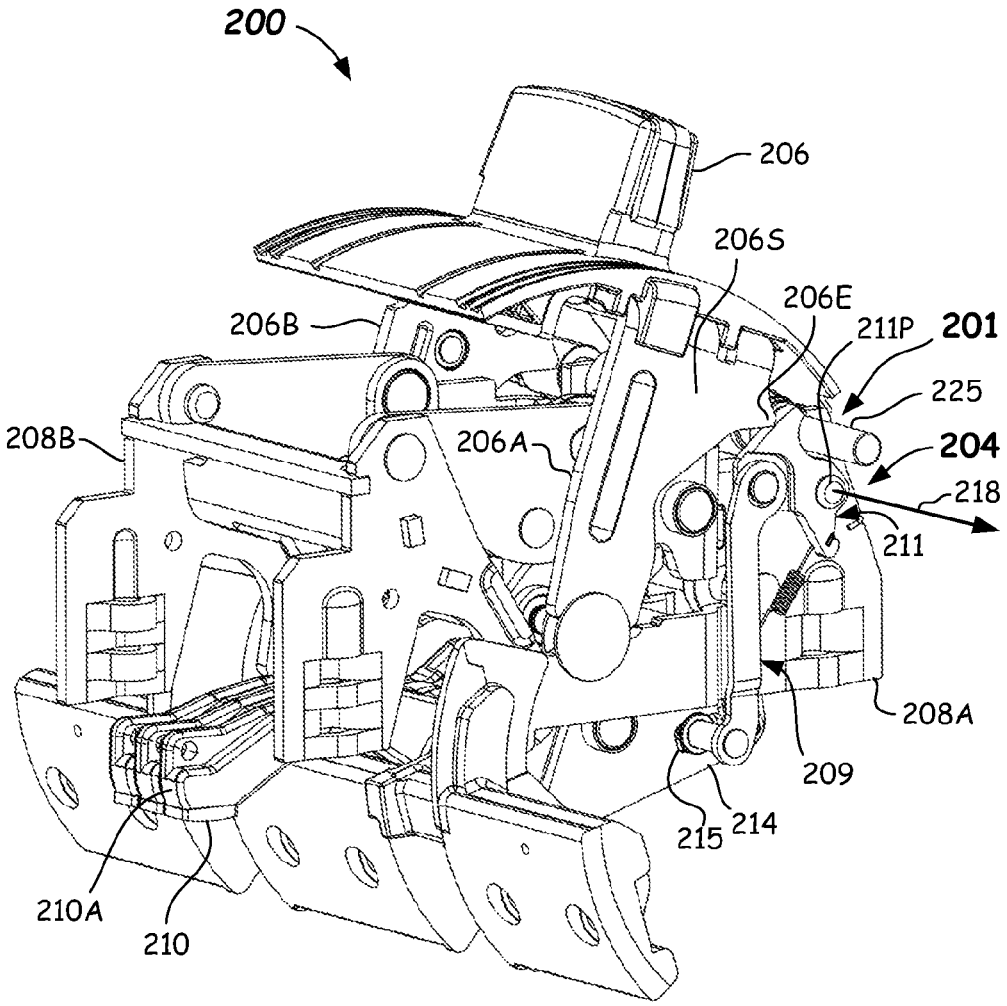
FIG. 2A illustrates an isometric view of a circuit breaker including an improved off-stop mechanism shown in a blocked orientation according to one or more embodiments.
Figure 2B:
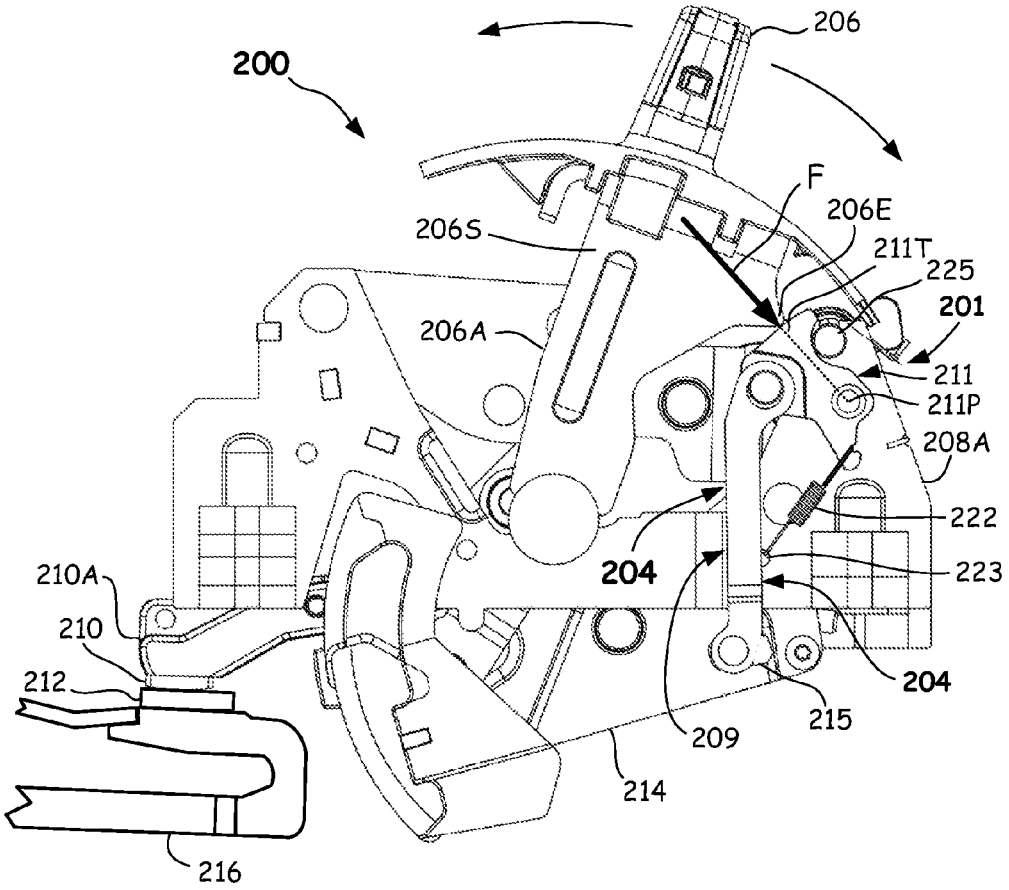
FIG. 2B illustrates a side plan view of a circuit breaker including an improved off-stop mechanism according to one or more embodiments.

FIGS. 2A through 2B illustrate a circuit breaker 200 including the off-stop mechanism 201. The housing of the circuit breaker 200 and other common components are not shown for clarity. Circuit breaker 200 may be coupled between a power source and an electrical circuit to be protected by circuit breaker 200 (neither the power source nor the electrical circuit is shown in FIGS. 2A-2B). The electrical circuit may include one or more electrical loads (e.g., devices or appliances that operate with electrical power). Circuit breaker 200 may include a housing (not shown), which may be, e.g., an insulated molded case made of a plastic material, such as a glass polymer, and may be assembled from two or more parts in some embodiments. Housing may enclose the various mechanical and electrical components of the circuit breaker 200 (several of which are shown and described herein).

FIG. 2B illustrates main electrical contacts, namely moveable contact 210 and stationary contact 212 that may be separable either manually or automatically by operating mechanisms of the circuit breaker 200. Moveable contact 210 may be attached to, and moveable with, a movable contact arm 210A, and stationary contact 212 may be a stationary contact attached to a stationary electrode 216 (shown truncated), which may couple to a line-side terminal (not shown) of the circuit breaker 200. Movable contact arm 210A may be coupled to a tripping mechanism that controls the opening and closing of the moveable contact 210, wherein the details of the tripping mechanism are well known and are not described herein. In some embodiments, multiple moveable contact arms 210A and multiple moveable contacts 210 arranged in a side-by-side orientation may be provided, as shown in FIG. 2B.

An operating handle 206 may be pivotally mounted on a first side frame 208A and/or on a second side frame 208B and the operating handle 206 may be moveable relative to a side frame 208A and/or 208B. As shown, operating handle 206 may be configured to rotate as shown via double-headed arrows (FIG. 2B). Operating handle 206 is shown in FIGS. 2A and 2B in a blocked configuration which, in accordance with an aspect of the invention, prevents the operating handle 206 from being moved to the OFF configuration under certain circumstances, which could inappropriately indicate that power is disconnected from the power source (i.e., when the main contacts 210, 212 are fused).

The blocking function shown is provided by a portion of a blocking assembly 204 engaging with a blocking engagement portion 206E of the operating handle 206. Blocking assembly 204 includes a linkage 209 and a blocking member 211, which may be pivotally coupled to one another. In operation, the blocking engagement portion 206E may be an extending tab projecting from a side 206S of the operating handle 206. For example, blocking engagement portion 206E may be formed on one side of a U-shaped portion of the operating handle 206, as shown. The blocking member 211 may be a rigid member pivotally mounted to a side frame (e.g., to first side frame 208A) at a pivot location 211P. Blocking member 211 may include a blocking contact portion 211T configured to be contacted by the blocking engagement portion 206E when the blocking member 211 is positioned in a blocking configuration (as shown). The blocking engagement portion 206E may extend from only one side 206S of a U-shaped portion of the operating handle 206 including a first leg 206A and a second leg 206B, which may be made of a rigid material, such as metal (e.g., steel). To minimize the moment of inertia and minimize the propensity of buckling of the blocking member 211, the blocking member 211 is made short in relationship to the center-to center length of the linkage 209. For example, the center-to-center length of the linkage 209 between a cross bar pivot location at the first end 209A and the linkage attachment location at the send end 209B is at least two times larger than a distance between the pivot location 211P and the blocking contact portion 211T. In some embodiments, that distance is three times, or more, as much. In accordance with another feature, in the blocked orientation, the linkage attachment location may be located between the pivot location 211P and operating handle 206.

Figure 3A:
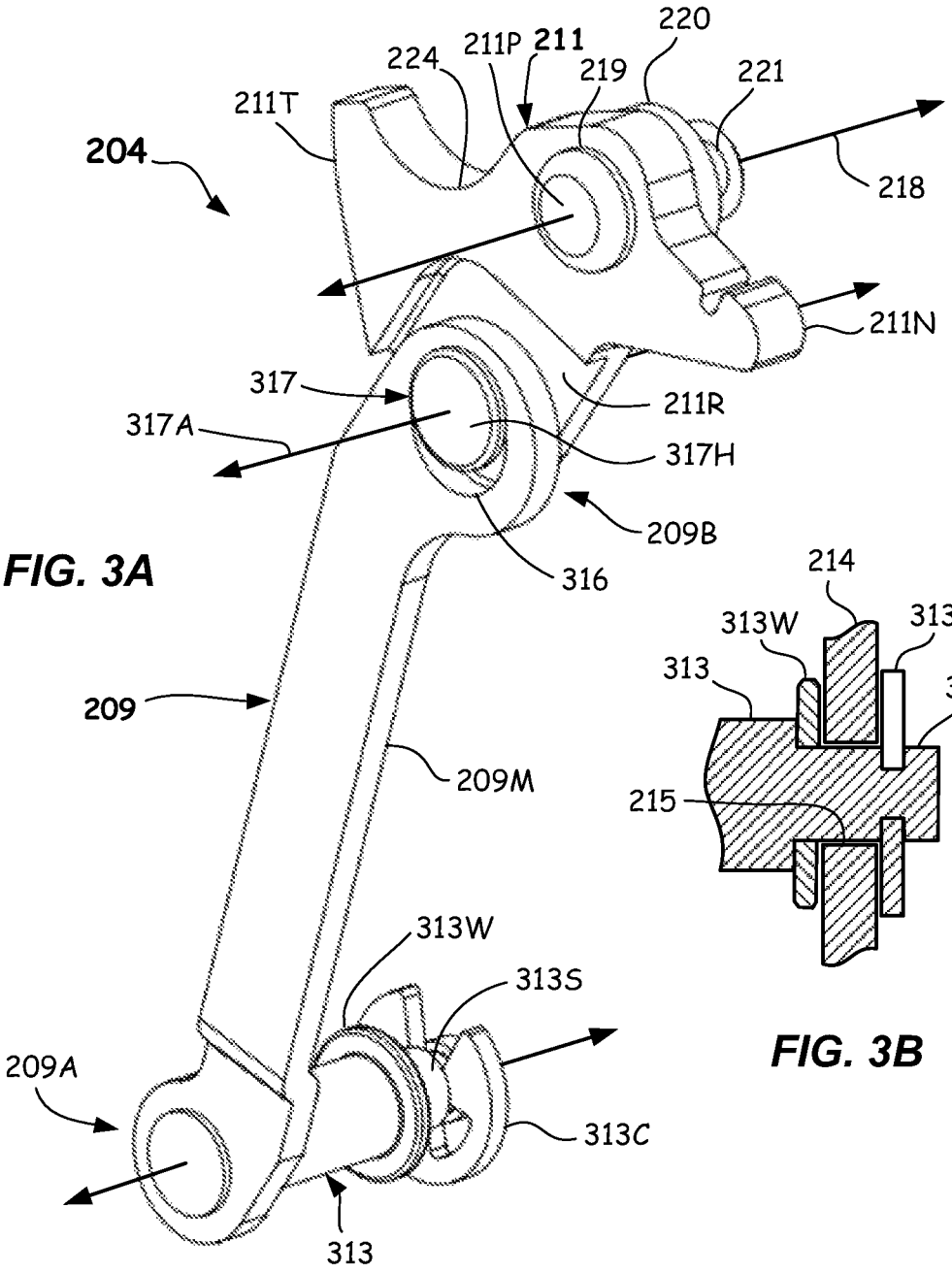
FIG. 3A illustrates an isometric view of a blocking assembly according to one or more embodiments.
Figure 3B:
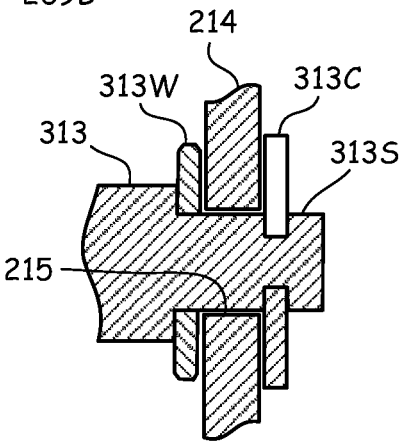
FIG. 3B illustrates a cross-sectioned side view of a first end of a linkage of a blocking assembly according to one or more embodiments.

In more detail, and referring to FIGS. 2A-2B and FIGS. 3A-3B, the linkage 209 of the blocking assembly 204 may include a first end 209A and a second end 209B. The first end 209A (as best shown in FIG. 3A) may include a shaft 313 that may extend perpendicularly from a main portion 209M of the linkage 209. An outer end of the shaft 313 may include a stepped-down portion 313S that includes a smaller dimension than an adjacent portion forming a stepped shaft. For example, the stepped-down portion 313S may be of a smaller diameter and may include thereon a washer 313W (e.g., a flat washer) and a retainer 313C (e.g., C-clip shown) that may function to pivotally connect the first end 209A of the linkage 209 to a portion (e.g., a planar side portion) of the cross bar housing 214 (See FIGS. 2A-2B). For example, as shown in FIG. 3B, the stepped-down portion 313S of the shaft 313 may include washer 313W on one side of the cross bar housing 214, and the retainer 313C on the other side with enough clearance to allow relatively free rotation thereof. The inner end of the shaft 313 may be rigidly coupled to the main portion 209M of the linkage 209, such as by riveting (enlarging) an inner portion of shaft 313 inserted through a hole in the first end 209A of the main portion 209M of linkage 209. Other suitable attachment means, such as welding, integrally forming, or the like may be used. Additionally, the first end 209A of the linkage 209 may be slidably coupled to a side of the cross bar housing 214.

For example, the side of the cross bar housing 214 may include a slot 215 (e.g., an elongated hole) into which the shaft 313 (e.g., stepped-down portion 313S) is received so that the first end 209A may move or slide along the length of the slot 215. Slot may be linear or slightly curved along a length thereof. In the depicted embodiment, the shaft 313 may slide in the slot 215. For example, the shaft 313 may move from end-to-end in the slot 215 by an amount of about 4 mm or more, and between about 4 mm and 7 mm in some embodiments.

The second end 209B of the linkage 209 may include an aperture 316 formed therein, which may be pivotally coupled to the blocking member 211. For example, as shown in FIG. 3A, the aperture 316 may be received over a pilot 317 of the blocking member 211. The pilot 317 may include a head 317H that includes a larger dimension than a shaft portion thereof (shaft portion not shown in FIG. 3A), such that the head 317H may overlap the hoop portion of the second end 209B of the linkage 209 so as to restrict lateral motion between the linkage 209 and the blocking member 211 along pivot axis 317A, yet allow rotation between the pilot 317 and the shaft portion about the pivot axis 317A. The aperture 316 may include a larger dimension than the head 317H, so that the linkage 209 may be flexed along its length, received over the head 317H, and installed in place.

The blocking member 211 may include a nose portion 211N and a blocking contact portion 211T. The nose and blocking contact portions 211N, 211T may be located on opposite sides of a pivot location 211P including a pivot axis 218 formed by coupling the blocking member 211 for rotation to a side frame (e.g., to the first side frame 208A). Coupling may be provided by inserting a step shaft rivet 219 through a hole in the blocking member 211 and riveting the shaft to the body of the blocking member 211, inserting a washer 220 over a larger-diameter portion (not shown) of the step shaft rivet 219, and riveting (enlarging) the smaller-diameter portion 221 on the side of the first side frame 208A opposite from the washer 220. Optionally, the blocking assembly 204 may be installed on the other side of the circuit breaker 200.

In some embodiments, a recess 211R may be provided on a side of the blocking member 211 to position a bearing surface of aperture 316 the linkage 209 more in line with a line of action of a spring force acting on the nose 211N of the blocking member 211 by a return spring 222. Return spring 222 may be a coil spring having ends that couple to the nose 211N of the blocking member 211 and to the first side frame 208A, for example. Other suitable spring types may be used. The return spring 222 may register in a notch formed in the nose 211N and in a hole 223 formed in the first side frame 208A, as shown. Other suitable connections may be used. The return spring 222 may be of a sufficient strength to provide a return torque of about 15 N-mm, for example, and between about 10 N-mm and about 40 N-mm in some embodiments. Other spring rates may be used.

In some embodiments, a relief 224 (FIG. 3A) may be formed in the blocking member 211 between the pivot location 211P and the blocking contact portion 211T. The relief 224 may be configured to contact a trip shaft 225 (FIG. 2A-2B) when the blocking member 211 is in the blocked orientation, as shown therein. This may further support the blocking member 211 when in the blocking orientation. The relief 224 may be formed as a radius having a radius dimension that is slightly larger than a diameter of the trip shaft 225, for example. Other shapes and dimensions of the relief 224 may be used.

The blocking function provided by one or more embodiments of the invention may occur when the main contacts 210, 212 have undesirably become fused (e.g., welded) together. Thus, as the user attempts to exert a force on the operating handle 206 to move the operating handle 206 to an OFF configuration (FIG. 2B), the cross bar housing 214 cannot rotate due to the fused main contacts 210, 212 and thus the blocking assembly 204 is maintained in a blocking orientation, as is shown in FIGS. 2A-2B. The blocking occurs when the blocking engagement portion 206E of the operating handle 206 rotates and contacts the blocking contact portion 211T of the blocking member 211, as shown. As contact occurs, the force vector F (FIG. 2B) exerted by the blocking engagement portion 206E acts on the blocking contact portion 211T in a manner that the force vector is directed substantially through the pivot location 211P, as shown by dotted line. Thus, as the operating handle 206 is moved to the OFF configuration, the engagement places the blocking member 211 under a compressive force between the pivot location 211P and the blocking contact portion 211T. Thus, bending stresses are minimized.

Figure 6:
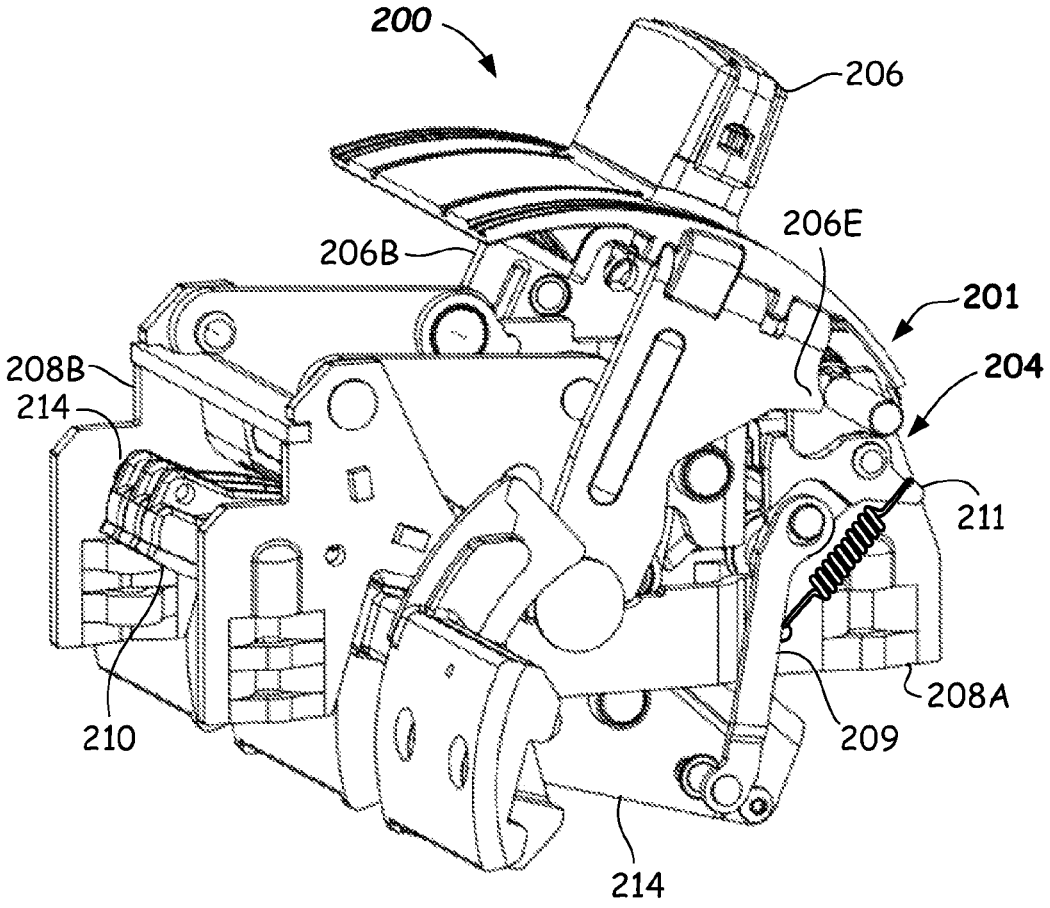
FIG. 6 illustrates an isometric view (with portions not shown for clarity) of a circuit breaker in the OFF configuration according to embodiments.

According to another aspect, operating handle 206 may also be rotated manually by a user to an OFF configuration, as shown also in FIG. 6, when the main contacts 210, 212 are not fused. Both the TRIPPED and OFF configurations normally indicate that power is disconnected from the electrical circuit.

Figure 4:
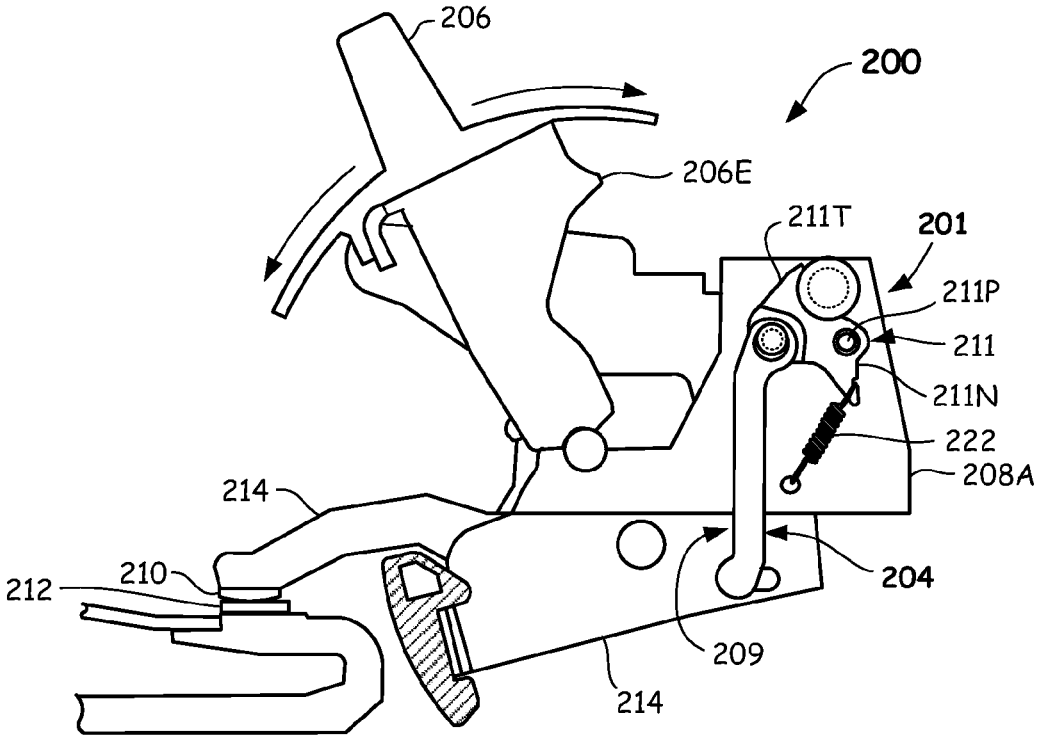
FIG. 4 illustrates a side plan view of a circuit breaker (with portions not shown for clarity) including an improved off-stop mechanism in the ON configuration according to one or more embodiments.
Figure 5:
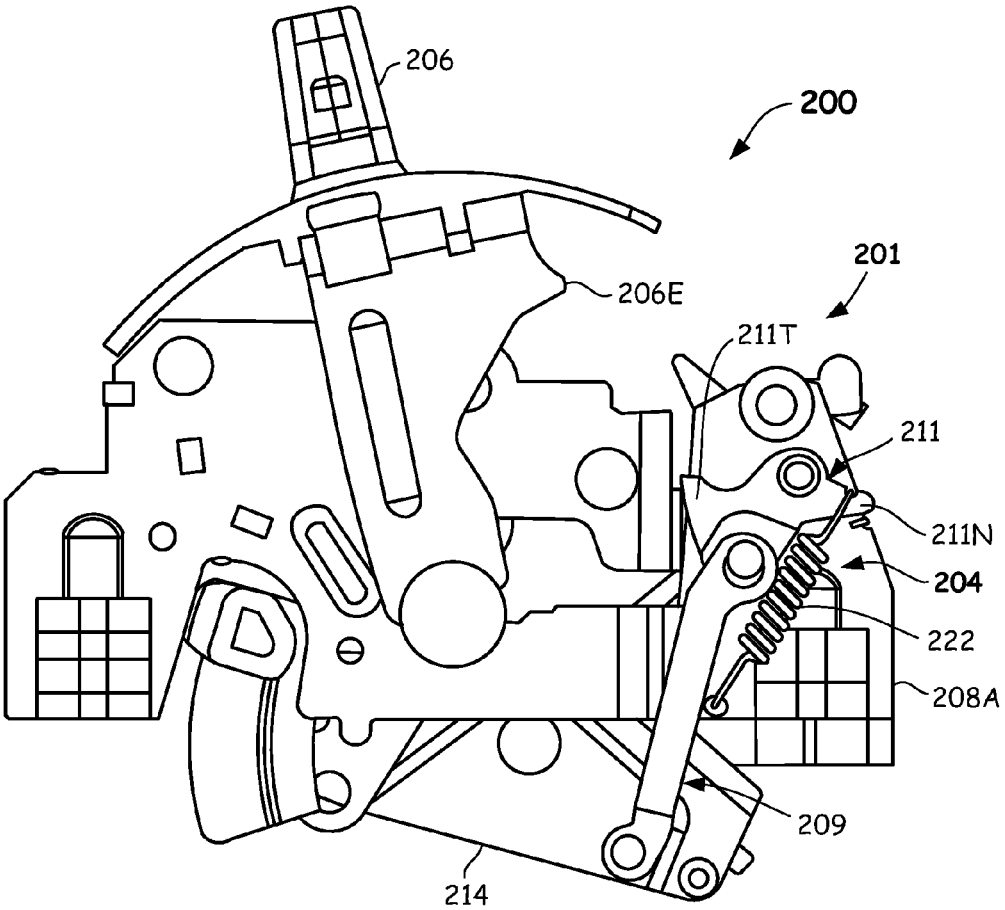
FIG. 5 illustrates a side plan view (with portions not shown for clarity) of circuit breaker in the TRIPPED configuration according to one or more embodiments.

FIG. 4 illustrates the operating handle 206 set in an ON configuration, which indicates that the main contacts 210 and 212 are closed, thereby allowing current to flow from the power source through circuit breaker 200 to the electrical circuit. Movement of operating handle 206 automatically into a TRIPPED configuration is shown in FIG. 5. Moving the operating handle 206 manually into the unblocked OFF configuration in FIG. 6, indicates that movable contact arm (or arms) 210A and moveable contact (or contacts) 210 has moved away from stationary contact 212, thus opening (i.e., physically and electrically separating) main contacts 210 and 212 from each other. In the unblocked orientation, the blocking member 211 and linkage 209 are configured so that the blocking engagement portion 206E may move past the blocking contact portion 211T. These automatic and manual movements normally result in power to the electrical circuit from the power source being disconnected. However, as described above, should the main contacts 210 and 212 become fused or otherwise welded together; manual movement of operating handle 206 into OFF configuration will be prohibited and blocked according to embodiments of the disclosure.

Figure 7:
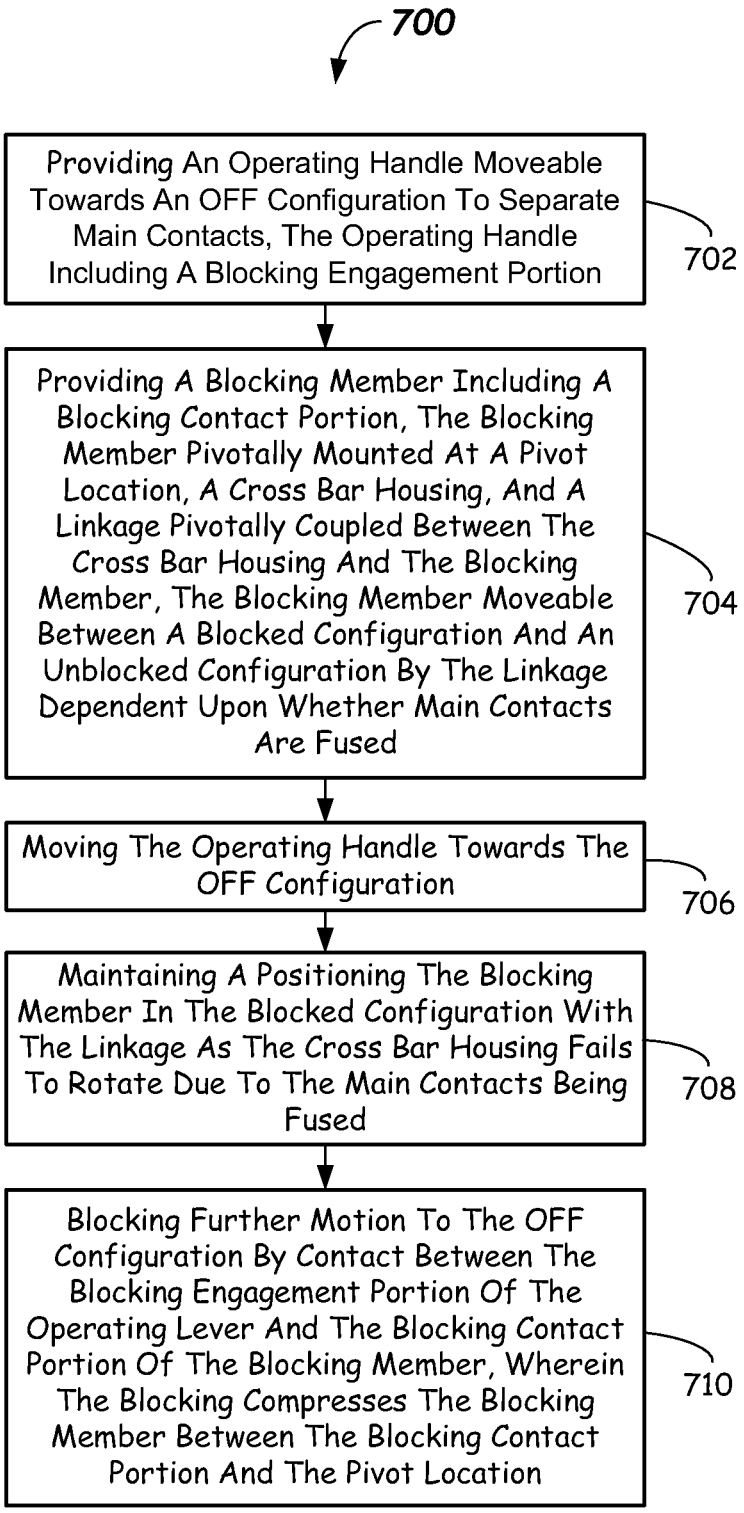
FIG. 7 illustrates a flowchart of a method of operating a circuit breaker including an off-stop mechanism according to one or more embodiments.

FIG. 7 illustrates a flowchart of a method 700 of operating a circuit breaker including an off-stop mechanism (e.g., off-stop assembly 204) according to one or more embodiments. The method includes, in 702, providing an operating handle (e.g., operating handle 206) moveable towards an OFF configuration to separate main contacts (e.g., main contacts 210, 212), the operating handle including a blocking engagement portion (e.g., blocking engagement portion 206E).

In 704, the method 700 provides a blocking member (e.g., blocking member 211) including a blocking contact portion (e.g., blocking contact portion 211T), the blocking member pivotally mounted at a pivot location (e.g., pivot location 211P), a cross bar housing (e.g., cross bar housing 214), and a linkage (e.g., linkage 209) pivotally coupled between the cross bar housing and the blocking member, the blocking member moveable between a blocked configuration and an unblocked configuration by the linkage dependent upon whether main contacts (e.g., main contacts 210, 212) are fused.

The method 700, in 706, includes moving the operating handle (e.g., operating handle 206) towards the OFF configuration, and, in 708, maintaining a positioning of the blocking member (e.g., blocking member 211) in the blocked configuration with the linkage (e.g., linkage 209) as the cross bar housing (e.g., cross bar housing 214) fails to rotate due to the main contacts (e.g., main contacts 210, 212) being fused.

Further, the method provides for blocking further motion to the OFF configuration by contact between the blocking engagement portion (e.g., blocking engagement portion 206E) of the operating handle (e.g., operating handle 206) and the blocking contact portion (e.g., blocking contact portion 211T) of the blocking member (e.g., blocking member 211), wherein the blocking compresses the blocking member (e.g., blocking member 211) between the blocking contact portion (e.g., blocking contact portion 211T) and the pivot location (e.g., pivot location 211P). Further, the line of action of a force vector F exerted on the blocking member 211 (when blocking) may be substantially through the pivot location 211P. Some minor deviations (e.g., a few mm) from straight through the pivot location 211P may be tolerated. Thus, the blocking member 211 is provided in substantially pure compression between the blocking member (e.g., blocking member 211) and the blocking contact portion (e.g., blocking contact portion 211T). Substantially pure compression means that the loaded portions of the blocking member 211 are undergoing compression stress across substantially the entire cross-section thereof. Further, because the force vector F is substantially through the pivot location 211P, the loads in linkage 209 is substantially lowered as compared to the prior art configuration. As such, the linkage 209 comprises an only linkage coupled to the cross bar housing 214, i.e., only one assembly 204 is provided only on one side of the circuit breaker 200.

In some embodiments, the engaging of the operating handle may include preventing the operating handle from moving closer to the OFF configuration than about 7 to 10 degrees away from the OFF configuration, as best shown in FIGS. 2A and 2B. The above-described process blocks of the method 700 may be executed or performed in an order or sequence not limited to the order and sequence shown and described. For example, in some embodiments, process blocks 702 and 704 may be performed in either order, or may be performed simultaneously as part of an assembly process.

Persons skilled in the art should readily appreciate that the invention described herein is susceptible of broad utility and application. Many variations, modifications, and equivalent arrangements, will be apparent from or reasonably suggested by the disclosure, without departing from the substance or scope of the invention. Accordingly, while the invention has been described herein in detail in relation to specific embodiments, it should be understood that this disclosure is only illustrative and presents examples of the invention and is made merely for purposes of providing a full and enabling disclosure of the invention. This disclosure is not intended to limit the invention to the particular apparatus, devices, assemblies, systems, or methods disclosed, but, to the contrary, the intention is to cover all modifications, equivalents, and alternatives falling within the scope of the invention, as defined by the appended claims.

What is claimed is:

1. An off-stop mechanism for a circuit breaker, comprising:

an operating handle moveable to an OFF configuration, provided main contacts of the circuit breaker are not fused together, the operating handle including a blocking engagement portion;

a cross bar housing;

a blocking member pivotally coupled at a pivot location and rotatable between an unblocked orientation and a blocked orientation, the blocking member including a linkage attachment location and a blocking contact portion; and a linkage coupled between the cross bar housing at a first end and the linkage attachment location on the blocking member at a second end, the linkage being configured to:

position the blocking member in the unblocked orientation when the main contacts are not fused together, and configure the blocking member to a blocked orientation in response to the main contacts being fused together, wherein the blocking member in the blocked orientation is configured to engage the blocking engagement portion as the operating handle is moved to the OFF configuration and the engagement places the blocking member under a compressive force between the pivot location and the blocking contact portion.

2. The off-stop mechanism for a circuit breaker of claim 1, wherein the operating handle is moveable relative to a side frame and the blocking member is pivotally coupled to the side frame.

3. The off-stop mechanism for a circuit breaker of claim 1, wherein the linkage comprises an only linkage coupled to the cross bar housing.

4. The off-stop mechanism for a circuit breaker of claim 1, wherein the blocking member comprises a blocking contact portion and a nose portion, the blocking contact portion adapted to be contacted by the blocking engagement portion of the operating handle and the nose portion is coupled to a return spring.

5. The off-stop mechanism for a circuit breaker of claim 1, wherein the linkage attachment location and the blocking contact portion are positioned on opposing sides of the pivot location.

6. The off-stop mechanism for a circuit breaker of claim 1, wherein the blocking engagement portion is formed on one side of a U-shaped portion of the operating handle.

7. The off-stop mechanism for a circuit breaker of claim 1, wherein the blocking member includes a pilot and a head on the pilot, and the linkage includes an aperture on the second end, and the aperture includes a dimension large enough to be received over the head.

8. The off-stop mechanism for a circuit breaker of claim 1, comprising:

a side plate including a hole formed therein, a nose portion of the blocking member, and a return spring coupled between the nose portion and the hole formed in the side plate.

9. The off-stop mechanism for a circuit breaker of claim 1, comprising a recess formed in the blocking member, and wherein the second end of the linkage is configured to be rotatable in the recess.

10. The off-stop mechanism for a circuit breaker of claim 1, wherein the linkage comprises a shaft rigidly attached at the first end of the linkage, wherein the shaft is pivotally mounted to the cross bar housing.

11. The off-stop mechanism for a circuit breaker of claim 10, wherein the shaft is slidably mounted in a slot formed in the cross bar housing.

12. The off-stop mechanism for a circuit breaker of claim 10, wherein the shaft comprises a smaller dimension portion, a washer and a clip coupled to the smaller dimension portion wherein the cross bar housing is received between the washer and the clip.

13. The off-stop mechanism for a circuit breaker of claim 1, wherein in the blocked orientation, a force vector acting on the blocking contact portion passes substantially through the pivot location.

14. The off-stop mechanism for a circuit breaker of claim 1, comprising a relief in the blocking member between the pivot location and the blocking contact portion, wherein the relief is configured to contact a trip shaft when the blocking member is in the blocked orientation.

15. The off-stop mechanism for a circuit breaker of claim 1, comprising a length of the linkage between a cross bar pivot and the linkage attachment location is at least two times larger than a distance between the pivot location and the blocking contact portion.

16. The off-stop mechanism for a circuit breaker of claim 1, comprising in the unblocked orientation, the blocking member and linkage are configured so that the blocking engagement portion moves past the blocking contact portion.

17. The off-stop mechanism for a circuit breaker of claim 1, comprising in the blocked orientation, the linkage attachment location is located between the pivot location and operating handle.

18. A circuit breaker, comprising:

first and second side frames;

an operating handle pivotally mounted to the side frames, the operating handle moveable to an OFF configuration provided main contacts of the circuit breaker are not fused together, the operating handle including a first leg and a second leg, and a blocking engagement portion on one of the first and second legs;

a cross bar housing;

a blocking member pivotally coupled to one of the first and second side frames at a pivot location and rotatable between an unblocked orientation and a blocked orientation, the blocking member including a linkage attachment location and a blocking contact portion; and a linkage coupled between the cross bar housing at a first end and the linkage attachment location on the blocking member at a second end, the linkage being configured to:

position the blocking member in the unblocked orientation provided that the main contacts are not fused together, and configure the blocking member to the blocked orientation if the main contacts are fused together, wherein the blocking member in the blocked orientation is configured to engage the blocking engagement portion as the operating handle is moved to the OFF configuration and the engagement places the blocking member under a compressive force between the pivot location and the blocking contact portion.

19. A method of operating a circuit breaker including an off-stop mechanism, the method comprising:

providing an operating handle moveable towards an OFF configuration to separate main contacts, the operating handle including a blocking engagement portion;

providing a blocking member including a blocking contact portion, the blocking member pivotally mounted at a pivot location, a cross bar housing, and a linkage pivotally coupled between the cross bar housing and the blocking member, the blocking member moveable between a blocked configuration and an unblocked configuration by the linkage dependent upon whether main contacts are fused;

moving the operating handle towards the OFF configuration; and positioning the blocking member in the blocked configuration with the linkage as the cross bar housing fails to rotate due to the main contacts being fused; and blocking further motion to the OFF configuration by contact between the blocking engagement portion of the operating handle and the blocking contact portion of the blocking member, wherein the blocking compresses the blocking member between the blocking contact portion and the pivot location.

* * * * *